United States Patent [19]

Vander Bok

[11] 4,327,677

[45] May 4, 1982

[54] SEMI-FLOATING VALVE BRIDGE

[75] Inventor: Arnold Vander Bok, Northville, Mich.

[73] Assignee: General Motors Corporation, Detroit, Mich.

[21] Appl. No.: 50,230

[22] Filed: Jun. 20, 1979

[51] Int. Cl.[3] ..... F01L 1/18

[52] U.S. Cl. ..... 123/90.4; 123/90.22

[58] Field of Search ..... 123/90.22, 90.23, 90.4, 123/308, 315, 432, 90.39

[56] References Cited

U.S. PATENT DOCUMENTS

| | | | |
|---|---|---|---|
| 2,385,959 | 10/1945 | Yingling | 123/90.4 |
| 3,179,094 | 4/1965 | Ribeton | 123/90.39 |
| 3,633,556 | 1/1972 | Inoue | 123/90.22 |
| 3,963,004 | 6/1976 | Lysinger et al. | 123/90.22 |

FOREIGN PATENT DOCUMENTS

| | | | |
|---|---|---|---|
| 2055665 | 5/1972 | Fed. Rep. of Germany | 123/90.4 |

*Primary Examiner*—Craig R. Feinberg
*Assistant Examiner*—W. R. Wolfe
*Attorney, Agent, or Firm*—Arthur N. Krein

[57] ABSTRACT

The valve bridge in a valve gear mechanism of the type used to effect actuation of a pair of adjacent valves in an internal combustion engine is provided at opposite ends thereof with through guide apertures that extend centrally upward from the crowned contact surfaces of the valve bridge. Each guide aperture is sized so as to loosely receive a guide pin extending upward from the free end of an associated valve stem whereby the valve bridge can be loosely held in aligned position relative to the valves.

2 Claims, 3 Drawing Figures

SEMI-FLOATING VALVE BRIDGE

This invention relates to a valve gear for an internal combustion engine of the type wherein two valves are simultaneously operated by a common valve bridge actuated by a rocker arm, and, in particular, to a semi-floating valve bridge mechanism for such a valve gear.

DESCRIPTION OF THE PRIOR ART

Valve gears of the type in which a valve bridge, actuated by a rocker arm, is used to control operation of a pair of valves in an engine are well known. In certain valve gear mechanisms, this valve bridge is pivotably connected to one end of the rocker arm for movement therewith whereby to effect operation of a pair of valves, in the manner shown, for example, in U.S. Pat. No. 3,021,826 entitled "Rocker Arm and Multiple Valve Actuating Mechanism" issued Feb. 20, 1962 to Albert De Fezzy et al.

In another form of this type valve gear mechanism, the valve bridge is suitably guided intermediate its ends for reciprocating movement whereby to effect operation of a pair of valves in the manner shown, for example, in U.S. Pat. No. 3,963,004 entitled "Two-Piece Valve Bridge" issued June 15, 1976 to Glenn W. Lysinger and James S. Sears.

SUMMARY OF THE INVENTION

The present invention relates to a valve gear mechanism in which a valve bridge, used to effect operation of a pair of valves in an internal combustion engine, and these valves are provided with cooperating means whereby to maintain alignment of the valve bridge relative to the valves while at the same time permitting the valve bridge to adjust for any variation in valve stem heights.

It is therefore the principle object of this invention to provide an improved valve gear mechanism whereby a semi-floating valve bridge and a pair of valves include cooperating means whereby alignment of the valve bridge with the valves is maintained and the valve bridge is free to automatically compensate for any variation in valve stem height.

Another object of this invention is to provide an improved valve bridge whereby the valve bridge can cooperate with a pair of valves to maintain its alignment relative to the valves while automatically adjusting itself for any variation in stem height of the valves.

Still another object of the present invention is to provide an improved valve bridge mechanism of the above type which includes features of construction, operation and arrangement, rendering it easy and inexpensive to manufacture, which is reliable in operation, and in other respects suitable for use on production internal combustion engines.

For a better understanding of the invention, as well as other objects and further features thereof, reference is had to the following detailed description of the invention to be read in connection with the accompanying drawings.

Figure 1:
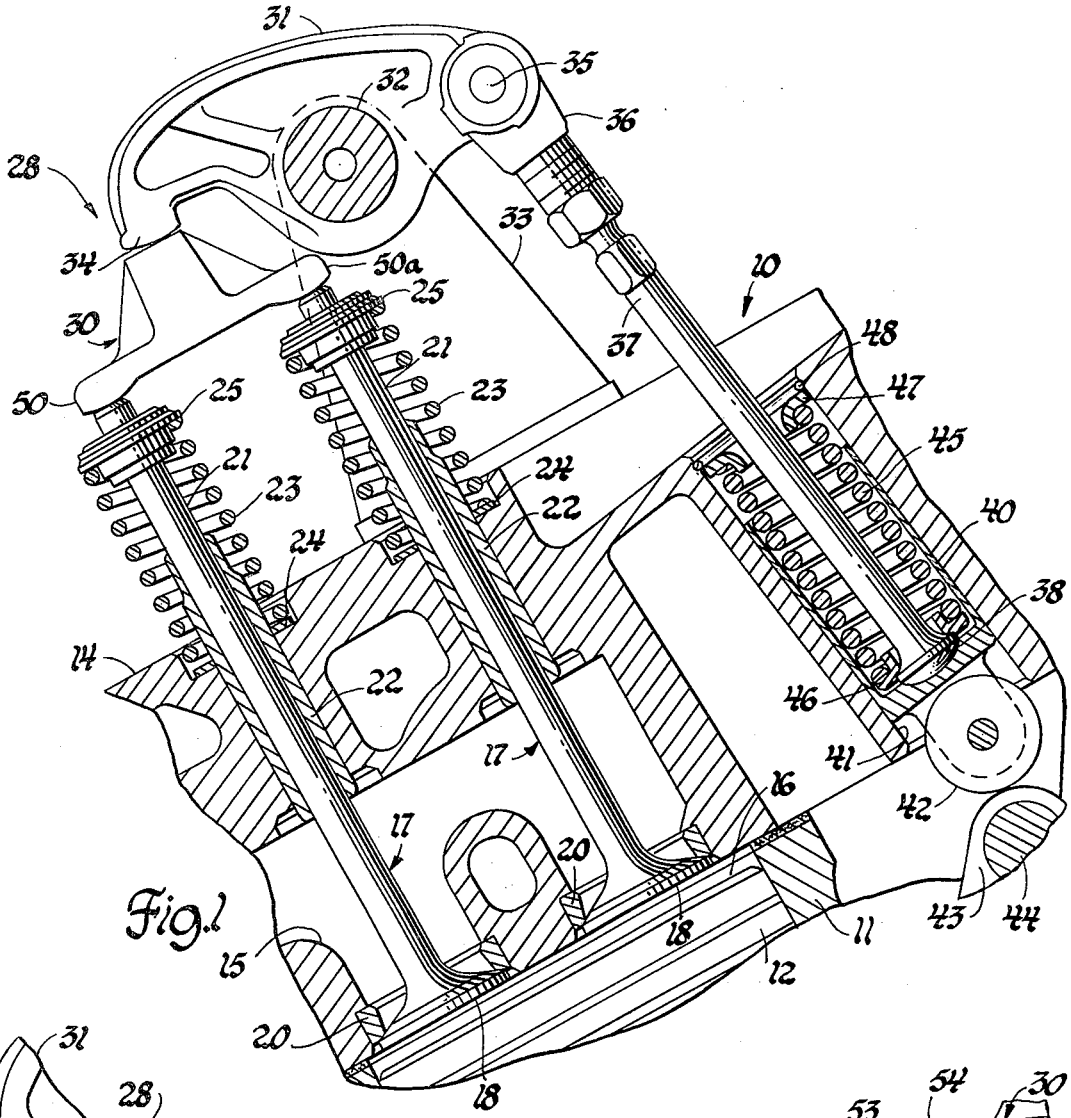
FIG. 1 is a cross-sectional view through a portion of an internal combustion engine showing the valve gear mechanism for operating a pair of valves, the valve gear mechanism including a valve bridge and valve arrangement in accordance with a preferred embodiment of the invention, the valves, push rod, rocker arm and valve bridge being shown in elevation.

As partly shown in FIG. 1, an internal combustion engine, such as a diesel engine generally designated 10, comprises a cylinder block 11 having at least one cylinder bore therein reciprocably mounting a piston 12.

A cylinder head 14 mounted on and sealed with respect to the cylinder block 11 closes the upper end of the cylinder bore to form therewith and with the reciprocating piston and expandable combustion chamber 16. The cylinder head 14 is provided with a passage 15 opening into the combustion chamber 16, through a pair of ports, the flow therethrough being controlled by two poppet type valves 17. Each of the valves 17 has a head 18 which is adapted to seat against an associated valve seat insert 20 mounted in the cylinder head 14 so as to define one of the ports. For the purpose of describing the subject invention, the passage 15 will be referred to as an exhaust passage, but it should be realized that this passage can either be an exhaust passage or an intake passage for the engine.

Each of the poppet valves 17 has a stem 21 which is reciprocably mounted in a valve guide 22 having a press fit in a mounting or valve guide bore extending through the cylinder head 14 and intersecting the passage 15. The upper end of each valve stem 21 projects above the cylinder head in a normal manner.

In a conventional manner, each valve 17 is normally maintained in a closed position with the head 18 seated against its associated valve seat insert 20 by a return spring 23. Each such return spring 23 encircles the upper portion of the associated stem 21 of the respective valve, with one end of the spring positioned so as to abut against a spring seat 24 on the cylinder head 14. The other end of the return spring 23 engages a conventional spring cap or retainer 25 suitably secured to the stem of the poppet valve by a conventional valve collet or lock 26. As is well known the valve lock 26 may be in the form of conically tapered split keys which are held on the groove end of the valve stem by wedging action of the cooperatively tapered portion of the spring retainer 25.

The poppet valves 17 are adapted to be actuated in unison between their closed and opened positions relative to their respective valve seat inserts 20 by the camshaft timed operation of a valve gear or actuator linkage mechanism indicated generally at 28.

In the construction shown, the linkage mechanism 28 includes a valve bridge 30 constructed in accordance with the invention, as described in detail hereinafter. A rocker arm 31 is pivotably journaled intermediate its ends on a shaft 32 which is suitably supported in a known manner above the cylinder head 14 by spaced apart brackets 33, only one of which is shown, suitably secured to the cylinder head 14. One end of the rocker arm 31 is provided with a tappet portion 34 which engages the upper portion of the valve bridge 30 to effect reciprocable movement of this valve bridge. The other end of the rocker arm 31, distal from the tappet portion 34 is pivotably connected at 35 to a clevis member 36 forming the upper end of a cam operated push rod 37.

As shown, the clevis member 36 is threadedly mounted for nut-locked lash adjustment on the upper end of the push rod 37. The opposite end of the push rod 37 is provided with a semi-spherical pallet 38 which is thrustably engageable with a semi-spherical seat provided in the lower closed end of a hollow cup-shaped cam follower 40. The cam follower 40 is reciprocably but non-rotatably mounted in a guide bore 41 provided in the cylinder head 14. A cam engaging roller 42 is carried by and suitably rotatably journaled with respect to the lower end of the cam follower 40. The cam follower 40 and the push rod 37 are biased downwardly to maintain the roller in engagement with the associated valve actuating cam lobe 43 of a cam shaft 44 by a spring 45 which is compressively interposed between a washer formed spring seat 46 carried by the pallet 38 of the push rod 37 and a second washer formed seat 47. The latter seat 47 is retained by means of a split ring retainer 48 positioned within an annular groove provided for this purpose in the upper end of the follower guide bore 41. This push rod assembly is adjusted to provide a predetermined lash value in the valve actuating linkage under engine operating conditions by means of the usual threaded adjustment provided between the clevis member 36 and the push rod 37.

Valve bridge 30, in the construction illustrated, includes a base in the form of a web member that defines a pair of arms 50 and **50*a* spaced from and extending transversely of a central upstanding rocker arm engaging tappet head 51. Each of the arms 50 and 50*a* adjacent to its free end is provided on its surface opposite the tappet head 51 with a suitable crowned contact face, in the form of an arcuate or semi-spherical pallet 52 in the construction shown, which is engageable with the upper end surface of the stem 21 of the valves 17** with which it is associated.

In accordance with the invention, cooperating alignment means are associated with the valve bridge 30 and the respective valves 17 whereby to maintain operative alignment of the valve bridge 30 relative to the valves 17 while at the same time permitting the valve bridge 30 to automatically adjust to any difference in the effective height of the valves 17.

Figure 2:
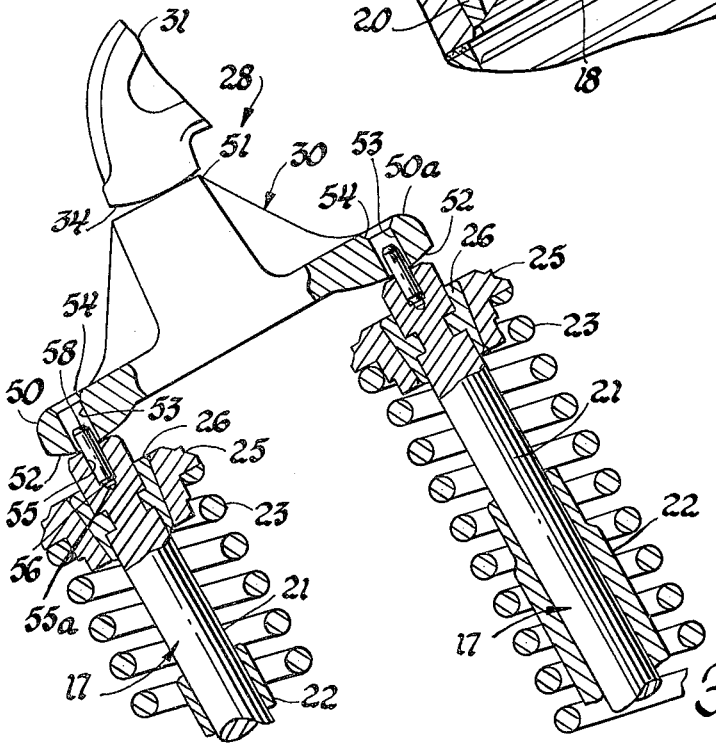
FIG. 2 is an enlarged sectional view of a portion of FIG. 1 with parts broken away to show the details of the valve bridge structure and cooperating elements of the valves constructed in accordance with a preferred embodiment of the invention, the valves being shown with substantially uniform heights; and, FIG. 3 is a further enlarged sectional view of one end of the valve bridge and associated valve stem of the valve bridge arrangement shown in FIG. 2, but with the valve shown having a shorter stem height than the adjacent valve, not shown.

For this purpose, each arm 50 and **50*a*, in the preferred embodiment shown, is provided adjacent to its free end with a through guide bore 53 that extends upward centrally of the respective pallet 52, as best seen in FIG. 2. Preferably, as shown, each guide bore 53 includes an enlarged counter-sunk opening 54** at its upper end whereby to provide an enlarged well opening for receiving lubricating fluid splashed therein during operation of the valve gear, which of course would be lubricated in a suitable conventional manner, not shown.

In addition, in this preferred embodiment, each valve stem 21 is provided with an axial blind bore 55 that extends downward from the upper free end of the valve stem. This blind bore 55, in the construction illustrated, is stepped so as to provide a flat shoulder 56 interconnecting the upper bore portion 55 and the lower reduced diameter bore portion **55*a*. A cylindrical guide pin 58, for example a roll pin, is suitably secured in the bore 55 of an associated valve stem whereby one end of the guide pin 58 abuts against the shoulder 56 therein, while the opposite end of the guide pin 58 extends axially outward a predetermined distance from the upper free end surface of the valve stem. The axial extent of the projecting portion of a guide pin 58 should be such so that it will project into an associated guide bore 53 of the valve bridge 30 a suitable distance so as to effect and maintain alignment of the valve bridge 30** relative thereto.

Figure 3:
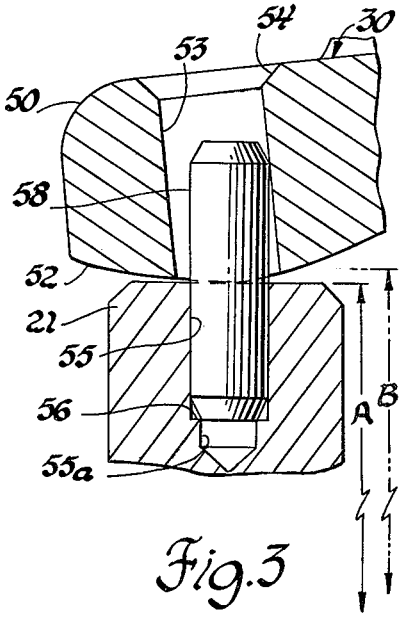

As best seen in FIGS. 2 and 3, the inside diameter of a guide bore 53 is preselected so as to be sufficiently larger than the outside diameter of the associated guide pin 58 whereby to provide for a suitable radial clearance between the guide bore wall 53 and the outer peripheral surface of the guide pin 58 as when these two elements are co-axial to each other. This clearance also accommodates the center to center variation in adjacent valve stems 21 and facilitates the supply of lubricating fluid flowing to the contact faces of the pallet 52 and the free end of the associated valve stem 21.

In FIGS. 1 and 2, the valve bridge 30 is illustrated as being positioned so as to contact the stems 21 of the valves 17 which are illustrated as being substantially the same height. However, by way of example there is shown in FIG. 3 wherein only the left hand valve stem 21, with reference to the Figures, an arrangement wherein the valve bridge has automatically adjusted itself for differences in valve stem heights. Thus with reference to FIG. 3, the left hand valve stem 21 has been shown having a height represented by the line A, while the other or right hand valve, not shown, has a height represented by the line B. With this arrangement of different valve stem heights, the pallet 52 of arm 50 of the valve bridge 30 would pivot on the free end surface of its associated left hand valve stem, as permitted by the radial clearance provided by the difference between the inside diameter of the guide bore 53 wall and the outside diameter of the guide pin 58, to a position corresponding to that shown. Of course, the opposite end of the valve bridge 30 would also be free to pivot about the free end of the other or right hand valve stem, not shown, in a similar manner since this movement can be readily visualized from the valve bridge and valve stem structural arrangement described. Thus both ends of the valve bridge 30 can automatically adjust to accommodate an adequate range of height difference in valve stem heights of an associated pair of valves 17 in the manner described for a particular engine application.

It will now be apparent to those skilled in the art that the different valve stem heights are accommodated by both the crown contact face of the valve bridge pivoting on the valve stem and by the radial clearance provided between the guide bore 53 in the valve bridge and the associated guide pin 58 fixed in the valve stem 21.

As previously referred to, the above described elements of the valve gear mechanism, including the valve bridge 30 engagement with the stems of valves 17 would be lubricated in a suitable manner, as by a conventional splash lubricating system, not shown or described, since the details of such a lubricating system are not deemed necessary for an understanding of the subject invention.

While the foregoing description has been limited to a preferred embodiment of the invention it will be apparent that various modifications and changes may be made as by having the elements containing the guide pins and guide bores therein reversed as by having the guide pin fixed to an arm of the valve bridge with a clearance guide bore for it provided in the associated valve stem. In addition, although the subject valve bridge has been shown and described as being actuated by a rocker arm, it will be apparent that other mechanism, such as an overhead cam could be used to actuate the valve bridge. Thus it will be appreciated that various modifications and changes may be made other than that described without departing from the spirit and scope of the invention defined in the following claims:

The embodiments of the invention in which an exclusive property or privilege is claimed are defined as follows:

1. In a valve gear mechanism for an internal combustion engine of the type having a cylinder head; a pair of spaced apart valves, each valve having a valve stem slidably received through a guide sleeve fitted into the cylinder head, the free end of each valve stem extending outward from the cylinder head; a valve actuating means mounted in spaced relation from the stems of the valves; and, a multi-valve actuating valve bridge operatively positioned between the valve actuating means and the stems of the valves; the improvement wherein said valve bridge is semi-floating and includes a web member having end portions providing crowned valve stem engaging surfaces on one side thereof for abutting against the respective free ends of the valve stems and an intermediate tappet head extending from the opposite side of said web member for engagement with the valve actuating means, and cooperating alignment means associated with each said end portion and the valve stem of an associated valve for loosely holding said valve bridge in aligned position relative to the valves, said cooperating alignment means including a guide bore in one of the associated said end portion and associated valve stem and a fixed guide pin extending from the other of said end portion and valve stem so as to be loosely received in said guide bore, said valve bridge thus being adapted to be supported by the valve stems and to be self-adjusting relative to the respective valve stems heights.

2. In a valve gear mechanism for an internal combustion engine of the type having a cylinder head; a pair of spaced apart valves, each valve having a valve stem slidably received through a guide sleeve fitted into the cylinder head, the free end of each valve stem extending outward from the cylinder head; a valve actuating means operatively positioned in spaced relation from the stems of the valves; and, a multi-valve actuating valve bridge operatively positioned between the valve actuating means and the stems of the valves; the improvement wherein said valve bridge includes a web member having end portions providing crowned pallet contact surfaces on one side thereof for abutment against the valve stems and for pivotal movement relative thereto and, an intermediate tappet head extending from the opposite side of said web member for engagement with the valve actuating means, said valve bridge having a guide bore extending centrally through each said crowned pallet contact surface; and, wherein a guide pin is fixed within each stem of a valve with a portion thereof extending axially outward from the valve stem so as to be loosely received in an associated said guide bore to thereby maintain alignment of said valve bridge relative to the valves while at the same time permitting said valve bridge to be semifloating so as to permit it to automatically adjust for any variation in valve stem heights.

* * * * *